US005486654A

United States Patent [19]

Hanak et al.

[11] Patent Number: 5,486,654

[45] Date of Patent: Jan. 23, 1996

[54] EASY-STRIP CABLE

[75] Inventors: Karl Hanak, Fumay; Daniel Prudhon, Pierreclos; Serge Damilo, Charleville-Mezieres; Patrick Rofidal, Fumay, all of France

[73] Assignee: Filotex, Draveil, France

[21] Appl. No.: 300,206

[22] Filed: Sep. 2, 1994

[30] Foreign Application Priority Data

Sep. 6, 1993 [FR] France ..... 93 10566
Jul. 22, 1994 [FR] France ..... 94 09105

[51] Int. Cl.[6] ..... H01B 7/34

[52] U.S. Cl. ..... 174/113 R; 174/36; 174/117 F

[58] Field of Search ..... 174/113 R, 36, 174/117 R, 117 F

[56] References Cited

FOREIGN PATENT DOCUMENTS 2510295 1/1983 France .
1371211 10/1974 United Kingdom .
1546609 5/1979 United Kingdom .

*Primary Examiner*—Morris H. Nimmo
*Attorney, Agent, or Firm*—Sughrue, Mion, Zinn, Macpeak & Seas

[57] ABSTRACT

An easy-strip cable includes individually insulated electrical conductors assembled into sets and a continuous insulative sheath around said sets and separating them into two groups. The sheath is divided into two tubular portions substantially partly open at facing locations along the cable and joined together by two peripheral continuity tongues allowing the sheath to be opened as required. The cable can be used as a high-frequency signal transmission cable.

9 Claims, 2 Drawing Sheets

EASY-STRIP CABLE

BACKGROUND OF THE INVENTION

1. Field of the Invention

The present invention concerns a cable including individually insulated conductors surrounded by at least one sheath which is easy to strip without requiring the use of a special stripping tool.

2. Description of the Prior Art

Document FR-A-2 645 358 describes an electrical cable which includes individually insulated conductors and a sheath directly surrounding them and can also include drain wires between the insulated conductors and the sheath. This cable can be stripped using a special cutting tool which prevents damage to the conductors. To this end the sheath has two pairs of ridges delimiting four longitudinal grooves in facing pairs in two parallel cutting planes, each of these planes intersecting the inside surface of the sheath but remaining outside the conductors and the drain wires, if any. Each ridge adjoins one of the grooves directly delimited and defined in this way. The sheath with its two pairs of ridges and grooves has a cross-section inscribed within a square.

The tool for stripping this cable has two articulated jaws received in the grooves of one pair and actuated to cut the sheath in the aforementioned cutting plane. In conjunction with the pairs of ridges and grooves defined on the sheath, this tool minimizes the risk of damaging the conductors.

Document U.S. Pat. No. 4,755,629 describes a cable for high-frequency signals which includes:

two pairs of individually insulated conductors, a continuous inner sheath around each pair or a split insulative inner sheath having a figure-of-eight or S-shape around both pairs, a screen around the two individual inner sheaths or the common inner sheath, and a protective outer sheath.

The respective inner sheaths on the two pairs have the advantage of separating the two pairs from each other. However, this cable is not easy to strip.

The figure-of-eight shape common inner sheath has two tubular portions joined together by a connecting lug in the common axial plane of the two tubular portions and two slots facing in opposite directions. The S-shape sheath also has two tubular portions joined by a slantwise connecting lug on opposite sides of their common axial plane and two slots on opposite sides of this connecting lug.

This figure-of-eight or S-shape inner sheath has the advantage of separating the two pairs from each other to reduce crosstalk between the pairs. The two slots enable the two pairs to be inserted into the existing inner sheath and therefore also direct removal of the pairs from this sheath without requiring any specific stripping operation. On the other hand, fitting pairs into this sheath can move the conductors and, more importantly, the presence of the two slots cannot achieve the correct distance between the screen and the conductors at their level. This results in increased losses and increased attenuation of signals conveyed by the split inner sheath cable as compared with a cable with two inner sheaths the same thickness as the split inner sheath that are not split.

An object of the present invention is to provide a cable that is easy to strip, especially at locations other than the cable ends, without requiring the use of a special cutting tool and having optimum performance in terms of high-frequency transmission.

SUMMARY OF THE INVENTION

The present invention consists in an easy-strip cable including individually insulated electrical conductors assembled into separate sets and at least one continuous insulative sheath around said sets and separating them into two groups, wherein each continuous insulative sheath has two tubular portions substantially partly open at facing locations along the cable, around said sets and separating the two groups, and two substantially parallel peripheral continuity tongues joining the two tubular portions, delimiting between them on said continuous insulative sheath a constriction whose width is less than the diameter of the insulated conductors and adapted by rupture of at least one of them to open said continuous insulative sheath as required.

This cable advantageously has at least one of the following additional features:

said tongues are substantially adjacent but not fused together, said tongues are adjacent and slightly adherent to each other but separable from each other, the cable has an exterior groove on at least one of said tongues constituting a weakened area from which the tongue can be ruptured, the continuous insulative sheath is extruded, the continuous insulative sheath is a single outer sheath of said cable or an inner sheath covered with a screen in turn covered with an outer sheath, the sets of insulative conductors are pairs or star quads.

The features and advantages of the present invention will emerge from the following description with reference to the appended drawings.

DETAILED DESCRIPTION OF THE PREFERRED EMBODIMENTS

Figure 1:
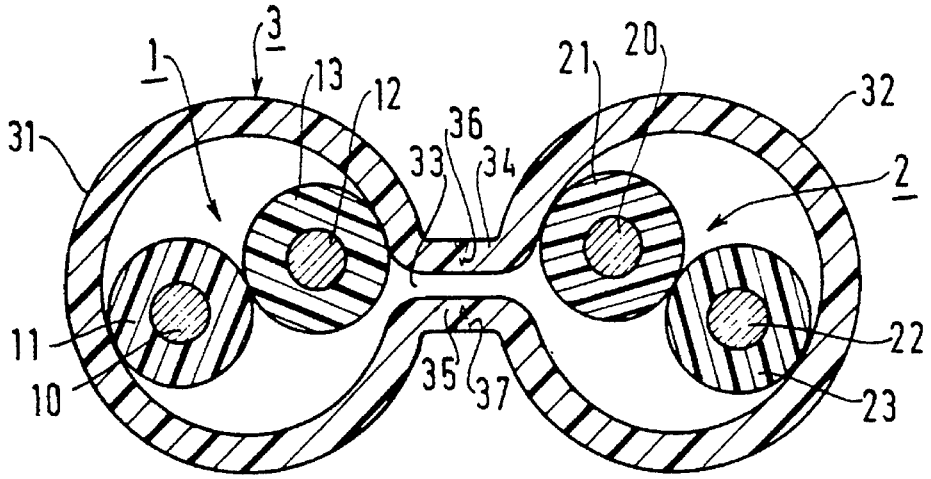
FIG. 1 shows a cable of the present invention in cross-section.

The cable shown in FIG. 1 includes two pairs 1 and 2 whose four conductors 10, 12, 20 and 22 have respective individual insulation 11, 13, 21 or 23 and a continuous insulative sheath 3. The sheath 3 is the protective outer sheath of the cable.

The sheath 3 has two cylindrical portions 31 and 32 which are slightly open lengthwise of the cable and joined together to form a constriction 33 of the sheath.

The sheath groups the two pairs 1 and 2 together but keeps them separate, each of the pairs being in one of the cylindrical portions 31 and 32 of the sheath 3. The periphery of the sheath 3 is continuous and for this purpose the sheath 3 has two connecting tongues 34 and 35 each joining one lip of one of these portions to one lip of the other portion and so together define the constriction 33.

The tongues 34 and 35 are substantially adjacent but are not fused together or are slightly spaced apart and substantially parallel. The constriction of the sheath that they delimit along the cable has a width less than the diameter of the insulated conductors inside the sheath. The sheath 3 as described is extruded.

Figure 2:
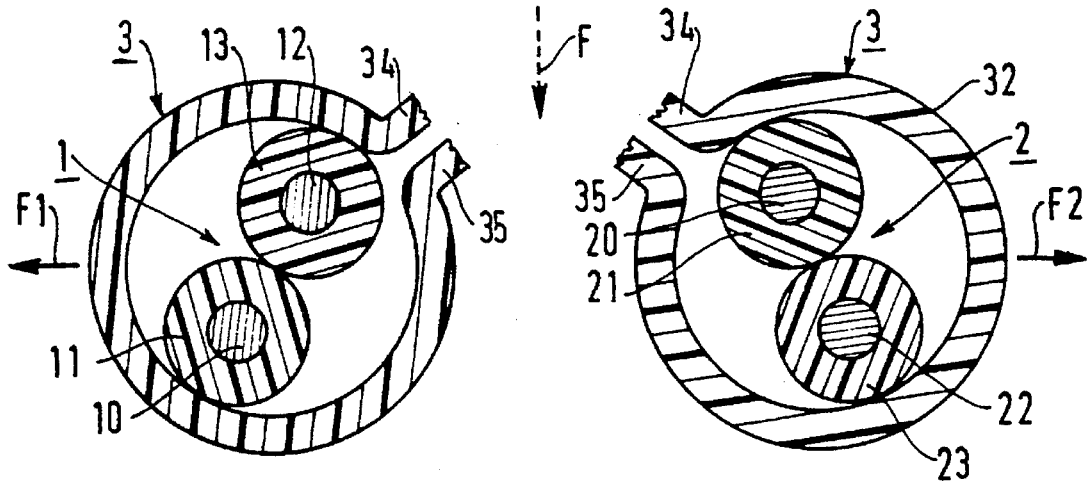
FIG. 2 shows the cable from FIG. 1 in cross-section and illustrates stripping of the cable.

FIG. 2 shows the stripping of this cable, which can be carried out at will at any part of the cable including the end of the cable. Stripping is effected by pulling apart, tearing or cutting the tongues to separate the portions 31 and 32 to open the sheath. This is achieved by pulling substantially transversely to the cable on either or both cylindrical portions 31 and 32, as shown schematically by the full-line arrows F1 and F2 associated with these portions, which ruptures the tongues or tears them away from one of the two portions, or by cutting before applying such traction, or by directly cutting at least one of the tongues as schematically shown by the dashed-line F. The insulated conductors are then extracted from the sheath which is cut away over a suitable length.

The sheath, designed to be stripped in this way without using special tools, prevents any damage to the insulated conductors inside it during stripping and enables the cable to be stripped at locations apart from its ends.

As an alternative to this, as shown in dashed line in FIG. 1, the sheath 3 further includes two shallow grooves 36 and 37 on the outside of the coupling tongues 34 and 35. These grooves constitute weakened areas from which the tongues can be ruptured. They are substantially opposed to each other and are either in the median part of the tongues or at one end thereof.

Figure 3:
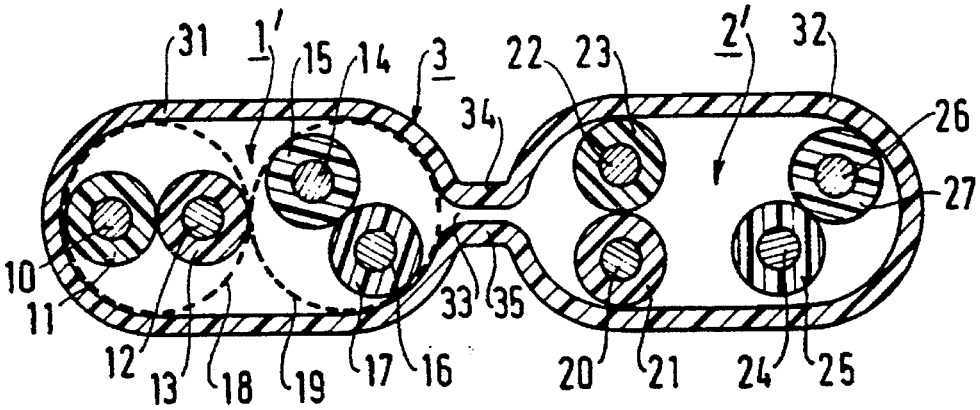
FIG. 3 is a view in cross-section of an alternative embodiment of the cable from FIG. 1.

The cable shown in FIG. 3 shows four pairs of individually insulated conductors and a continuous insulative sheath around them and separating them into two groups 1 and 1' each comprising two pairs. Four of these eight conductors and their individual insulation are identified by the same reference numbers as in FIG. 1 (10–11, 12–13, 20–21 and 22–23) and the other four and their insulation are identified by the reference numbers 14–15, 16–17, 24–25 and 26–27. The continuous insulative sheath is functionally identical to the sheath of the FIG. 1 cable. This sheath and its various parts are identified by the same reference numbers as used in FIG. 1 and are not described again. Suffice to say that the portions 31 and 32, which are cylindrical in FIG. 1, are substantially elliptical in FIG. 3. The connecting tongues are substantially parallel to the aligned major axes of the portions 31 and 32 and the resulting cable has a flat configuration.

The two insulated conductors of each pair can be held together, as schematically shown for the two pairs of the group 1' whose conductors are held under a tape, 18 or 19, according to the pair, shown in dashed line. These tapes are made from polyester or a like material and can have the exterior metallized to screen each pair.

The FIG. 3 cable is stripped in the same way as the FIG. 1 cable and its stripping is therefore neither shown nor described again. The subsequent separation of the conductors of any taped pair involves tearing and removing the tape.

Figure 4:
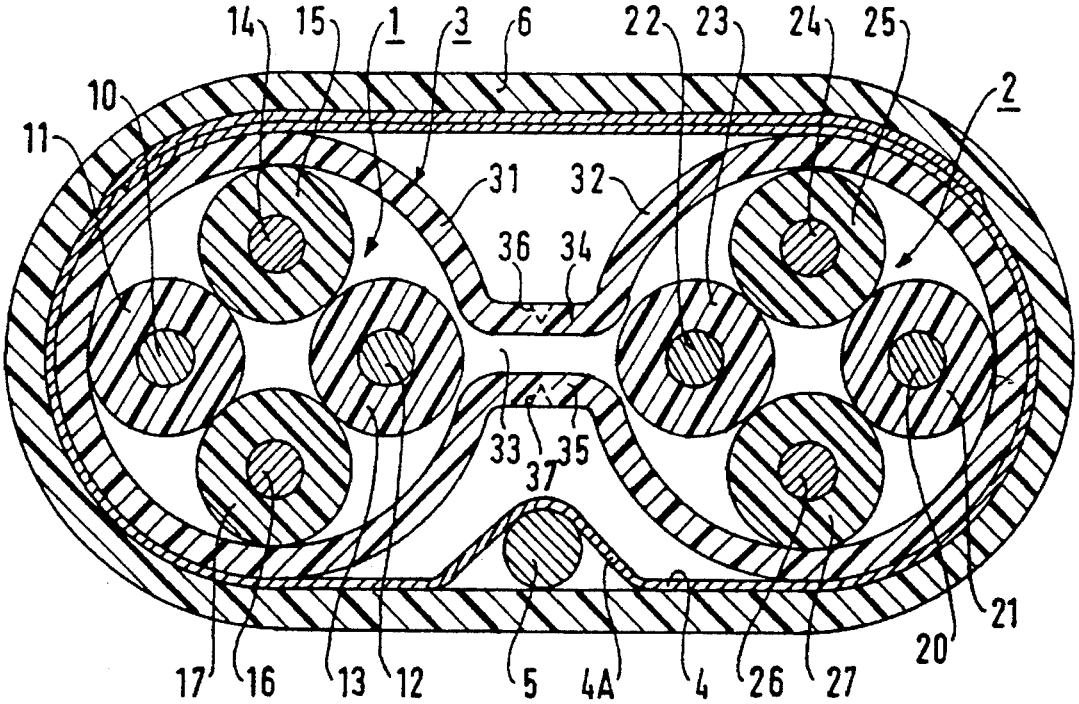
FIG. 4 shows in cross-section another embodiment of the easy-strip cable of the present invention with optimized transmission performance.
Figure 5:
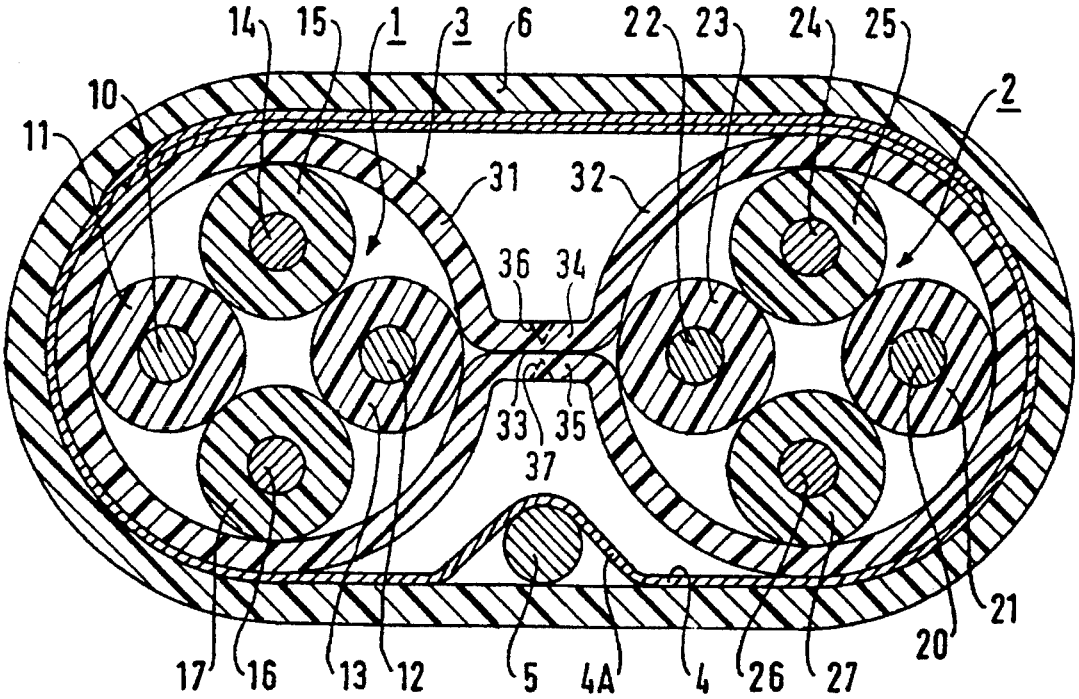
FIG. 5 shows a variant of the FIG. 4 embodiment.

In FIGS. 4 and 5 the cable includes two groups 1 and 2 of individually insulated conductors with the conductors and their insulation identified by the same reference numbers as in FIG. 3. The conductors are assembled into star quads, each group being defined directly by a single star quad. The two groups or quads are surrounded by a common continuous insulative sheath 3 which constitutes an inner sheath of the cable.

This inner sheath 3 has two cylindrical portions 31 and 32 which cover virtually all of the periphery of the two quads and are joined together to form a constriction 33 in the sheath.

The internal sheath 3 groups the two quads together whilst separating them from each other, each quad being within one of the cylindrical portions 31 and 32. Two tongues 34 and 35 join the two edges of one cylindrical portion to the facing edges of the other portion and ensure the peripheral continuity of the internal sheath around the two star quads.

In FIG. 4 these tongues are substantially adjacent but not fused together. They are parallel and independent of each other with the result that the two cylindrical portions are slightly open at facing locations. The constriction between them has a width less than the diameter of the insulated conductors.

In FIG. 5 these tongues are adjacent and slightly adherent to each other, although they are easily separated from each other. The constriction between them has a zero width at least in its median portion.

This continuous inner sheath 3 is extruded over the finished two quads. It holds them side-by-side and slightly spaced apart. During extrusion, if necessary, it replaces the insulated conductors of each quad, initially as identical to each other as possible, clamping them lightly together so that the conductors are in opposed pairs as strictly as possible at all points along the cable. It thereafter preserves the geometry of the quads and the side-by-side position of the two separate quads.

A screen 4 surrounds the inner sheath 3 completely and there is an associated screen continuity wire 5. An outer sheath 6 covers the screen and protects the cable.

The screen 4 is a metal or metallized foil fitted around the inner sheath with its edges overlapping. The screen continuity wire 1 is mounted between the screen and the outer sheath. It locates in a small longitudinal crease 4A in the screen formed in one of its parts between the cylindrical portions of the inner sheath and is secured to the latter by the outer sheath. The screen is sufficiently rigid to form the crease and to hold its opposite part taut between the two cylindrical portions of the inner sheath.

The cable from FIGS. 4 and 5 is stripped to obtain access to its conductors by cutting the outer sheath 6 over an appropriate length. This does not pose any particular problem or entail any risk of damage to the conductors inside the inner sheath and protected by the screen during removal of the outer sheath; this is followed by removing the screen and finally by pulling apart, tearing or cutting the continuity tongues of the inner sheath. As shown in dashed line, a V-section longitudinal groove 36 or 37 can be provided in each or both tongues to facilitate opening of the internal sheath. The insulated conductors are extracted and the internal sheath, or to be more precise its two cylindrical portions, are cut off over a suitable length.

As an alternative to what is shown in these figures, the continuous inner sheath can hold two pairs side-by-side rather that two quads, separating them from each other. Another alternative is for the outer sheath to hold side-by-side a first two quads or pairs which are grouped together in their continuous internal sheath, being separated from each other and from the two second quads or pairs which are themselves grouped together in their own continuous internal sheath and separated from each other.

The performance of the cable from FIGS. 4 and 5 is improved. It can achieve low levels of crosstalk, in the order of −60 dB at 20 MHz and −50 dB at 100 MHz, both within each quad or pair and between the quads or pairs.

The cables of the present invention are in particular suitable for transmission of data and/or telephony inside buildings. They usually comprise a relatively small number of insulated conductors or sets of conductors. They provide easy and quick access to the insulated conductors with no risk of damage to the latter and without requiring the use of any special cable stripping tool, in particular for their direct connection to equipment by means of insulation-displacement connectors in the equipment. The cables shown in the drawings and described hereinabove are exemplary embodiments of such cables.

These cables can also be hybrid cables with at least one of the two groups including individually insulated electrical conductors and/or individually or jointly protected optical conductors and in particular they can be in the form of ribbon cables.

There is claimed:

1. Easy-strip cable including individually insulated electrical conductors assembled into separate sets and at least one continuous insulative sheath around said sets and separating said set into two groups, wherein said at least one continuous insulative sheath has two tubular portions, substantially partly open at facing locations along the cable, around said sets and separating the two groups, and two substantially parallel peripheral continuity tongues, joining the two tubular portions, delimiting between said tongues on said continuous insulative sheath a constriction whose width is less than the diameter of the insulated conductors and at least one of said tongues being rupturable for opening said continuous insulative sheath as required.

2. Cable according to claim 1 wherein said tongues are substantially adjacent but not fused together and independent of each other.

3. Cable according to claim 1 wherein said tongues are adjacent and slightly adherent to each other but separable from each other.

4. Cable according to claim 1 having a longitudinal groove on at least one of the tongues constituting a weakened area from which it can be ruptured.

5. Cable according to claim 1 wherein said continuous insulative sheath is extruded.

6. Cable according to claim 1 wherein the sets are pairs and it includes at least one pair of insulative conductors in each of said tubular portions of said continuous insulative sheath.

7. Cable according to claim 1 including a single star quad in each of the tubular portions of said continuous insulative sheath.

8. Cable according to claim 1 wherein said continuous insulative sheath is a single outer sheath of the cable.

9. Cable according to claim 1 wherein said continuous insulative sheath is an inner sheath of the cable and is covered with a screen which is itself covered with an outer sheath.

* * * * *